US011738575B2

(12) United States Patent
Yasuda et al.

(10) Patent No.: US 11,738,575 B2
(45) Date of Patent: Aug. 29, 2023

(54) PRINTING APPARATUS

(71) Applicant: SCREEN HOLDINGS CO., LTD., Kyoto (JP)

(72) Inventors: Satoshi Yasuda, Kyoto (JP); Kazuki Fukui, Kyoto (JP); Makoto Shiomi, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 106 days.

(21) Appl. No.: 17/387,346

(22) Filed: Jul. 28, 2021

(65) Prior Publication Data

US 2022/0088943 A1 Mar. 24, 2022

(30) Foreign Application Priority Data

Sep. 23, 2020 (JP) ..... 2020-158400

(51) Int. Cl.

| | |
|---|---|
| ***B41J 11/00*** | (2006.01) |
| ***B41J 2/21*** | (2006.01) |
| ***B41J 11/46*** | (2006.01) |
| ***B41J 25/00*** | (2006.01) |

(52) U.S. Cl.

CPC ..... *B41J 11/0095* (2013.01); *B41J 2/2103* (2013.01); *B41J 11/008* (2013.01); *B41J 11/46* (2013.01); *B41J 25/001* (2013.01)

(58) Field of Classification Search

CPC .... B41J 11/0095; B41J 2/2103; B41J 11/008; B41J 11/46; B41J 25/001

See application file for complete search history.

(56) References Cited

U.S. PATENT DOCUMENTS

| | | | | |
|---|---|---|---|---|
| 8,643,688 | B1 * | 2/2014 | Chen | B41J 11/0095 347/217 |
| 2011/0109673 | A1 * | 5/2011 | Usuda | B41J 29/393 347/9 |
| 2012/0092432 | A1 | 4/2012 | Yasuda | |

(Continued)

FOREIGN PATENT DOCUMENTS

| | | |
|---|---|---|
| EP | 3 020 555 B1 | 9/2019 |
| JP | 02-43861 U | 3/1990 |

(Continued)

OTHER PUBLICATIONS

Extended European Search Report issued in corresponding European Patent Application No. 21188058.8-1017, dated Jan. 24, 2022.

*Primary Examiner* — Justin Seo
(74) *Attorney, Agent, or Firm* — McDermott Will & Emery LLP

(57) ABSTRACT

A printing apparatus for printing on a printing medium. The apparatus includes the following elements: a transport mechanism for transporting the printing medium in a transport direction; a first print head for printing an image on the printing medium, and printing a lead line used as a reference for determining a printing position in a width direction; a second print head for performing printing based on a position of the lead line; a printing position sensor for detecting the position of the lead line in the width direction; and a moving mechanism for moving the printing position sensor in the width direction of the printing medium according to a width dimension of the printing medium.

15 Claims, 6 Drawing Sheets

(56) References Cited

U.S. PATENT DOCUMENTS

| | | | | |
|---|---|---|---|---|
| 2013/0194334 | A1* | 8/2013 | Watanabe | B41J 25/006 347/12 |
| 2015/0273899 | A1* | 10/2015 | Samoto | B41J 2/01 347/16 |
| 2015/0290931 | A1 | 10/2015 | Boland et al. | |
| 2020/0406639 | A1 | 12/2020 | Yoshida et al. | |

FOREIGN PATENT DOCUMENTS

| | | | |
|---|---|---|---|
| JP | 11-139639 | A | 5/1999 |
| WO | 2019/131104 | A1 | 7/2019 |

* cited by examiner

PRINTING APPARATUS

BACKGROUND OF THE INVENTION

(1) Field of the Invention

This invention relates to a printing apparatus for printing on a printing medium, and more particularly to an apparatus which may print on printing media of various width dimensions. It also relates to a printing technique based on positions of a lead line in a width direction.

(2) Description of the Related Art

Conventionally, this type of apparatus, while transporting elongate printing paper, prints on a printing surface of the printing paper with a print head. With such an apparatus, when positional variations occur in a width direction with the transportation of the printing paper, the printing position from an end of the printing paper will shift. The apparatus therefore includes an edge control device having an edge sensor for detecting end positions of the printing paper, and an actuator operable in response to the edge positions detected by the edge sensor to move the printing paper in the width direction so that the end position of the printing paper may become constant. The edge control device including the edge sensor is located upstream of the print head.

Incidentally, the printing apparatus is usually constructed capable of printing on printing paper of various width dimensions. Therefore, in a mode of transporting the printing paper with reference to a middle portion, a change in the width of printing paper will change the end position of the printing paper. So, constructions have been proposed to move the edge sensor in response to a change in the width of printing paper. See Japanese Unexamined Patent Publications H11-139639 and Japanese Unexamined Utility Model Publication H2-43861.

Some types of printing apparatus have a plurality of print heads arranged at intervals in the transport direction. In such printing apparatus, while transporting printing paper using an edge control device, printing is performed by an upstream print head, and thereafter printing is performed by a downstream print head in fitting positions. For this purpose, the upstream print head prints a lead line indicating a reference position for printing in the width direction, and a printing position sensor disposed upstream of the downstream print head for detecting this lead line. Based on the position of the lead line detected by the printing position sensor, printing is done by the downstream print head with the position in the width direction adjusted. Consequently, a misalignment of printing position in the width direction between the upstream print head and downstream print head is suppressed to realize high quality printing.

SUMMARY OF THE INVENTION

However, the conventional example with such construction has the following problem.

The conventional apparatus only moves the position of the edge sensor located upstream of the print head in the width direction according to the width dimension of the printing paper. Even if such construction is applied, the positional relationship in the width direction between the upstream print head and downstream print head cannot be in alignment. There remains a problem of failing to provide high quality printing.

This invention has been made having regard to the state of the art noted above, and its object is to provide a printing apparatus which can cope with high quality printing even when a change is made to a printing medium having a different width dimension.

To fulfill the above object, this invention provides the following construction.

This invention provides a printing apparatus for printing on a printing medium, comprising a transport mechanism for transporting the printing medium in a transport direction; a first print head for printing an image on the printing medium transported by the transport mechanism, and printing a lead line used as a reference for determining a printing position in a width direction of the printing medium; a second print head disposed downstream of the first print head for performing printing according to the image printed by the first print head based on a position of the lead line in the width direction; a printing position sensor disposed downstream of the first print head and upstream of the second print head for detecting the position of the lead line in the width direction; and a moving mechanism for moving the printing position sensor in the width direction of the printing medium according to a width dimension of the printing medium.

According to this invention, the first print head prints an image along with the lead line on the printing medium transported by the transport mechanism. The second print head performs printing fit to the image printed by the first print head based on the lead line. The printing position sensor, which detects the lead line, is moved in the width direction of the printing medium by the moving mechanism. Consequently, even when a change is made to a printing medium having a different width dimension, the printing position sensor can be moved to an appropriate position. As a result, even when a change is made to a printing medium of different width dimension, high quality printing is assured.

In this invention, it is preferred that the apparatus further comprises an input unit for inputting the width dimension of the printing medium, and a controller for controlling the moving mechanism according to the width dimension inputted at the input unit in order to move the printing position sensor.

The controller operates the moving mechanism according to the width dimension inputted at the input unit. Consequently, the printing position sensor can be moved automatically to a position suitable for detecting the lead line according to the width dimension of the printing medium. As a result, there is no possibility of the printing position sensor being moved to a wrong position, and no lowering of printing quality.

In this invention, it is preferred that the moving mechanism includes a slider for supporting the printing position sensor to be movable at least between an inner position in the width direction appropriate to a minimum width of the printing medium and an outer position in the width direction appropriate a maximum width of the printing medium; and an actuator for moving the printing position sensor along the slider.

The moving mechanism includes the slider and actuator. Thus, the actuator can move the printing position sensor at least between the inner position and outer position.

In this invention, it is preferred that, when the printing medium is replaced with a printing medium having a different width dimension, the printing position sensor is once withdrawn outward of the outer position, the printing medium having the different width dimension is installed, and thereafter the printing position sensor is moved toward the inner position appropriate to the width dimension.

When a change is made to a printing medium having a different width dimension, the printing position sensor is once withdrawn outward of the outer position. Then, after the printing media are changed, the printing position sensor is moved toward the inner position according to the width dimension. Consequently, when a change is made to a wider printing medium, the printing medium can be prevented from inadvertently contacting the printing position sensor to be damaged.

In this invention, it is preferred that the printing position sensor is located in a position resulting from the transport direction switched to a substantially right-angled direction at least twice by the transport mechanism after the printing by the first print head.

After the transport direction is switched to a substantially right-angled direction at least twice by the transport mechanism, the distance between the first print head and second print head becomes considerably long. Consequently, a positional discord tends to occur between the image printed by the first print head and the image printed by the second print head. This gives significance to the adjustment, made by means of the printing position sensor, of printing in the width direction based on the lead line.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

An embodiment of this invention will be described hereinafter with reference to the drawings.

Figure 1:
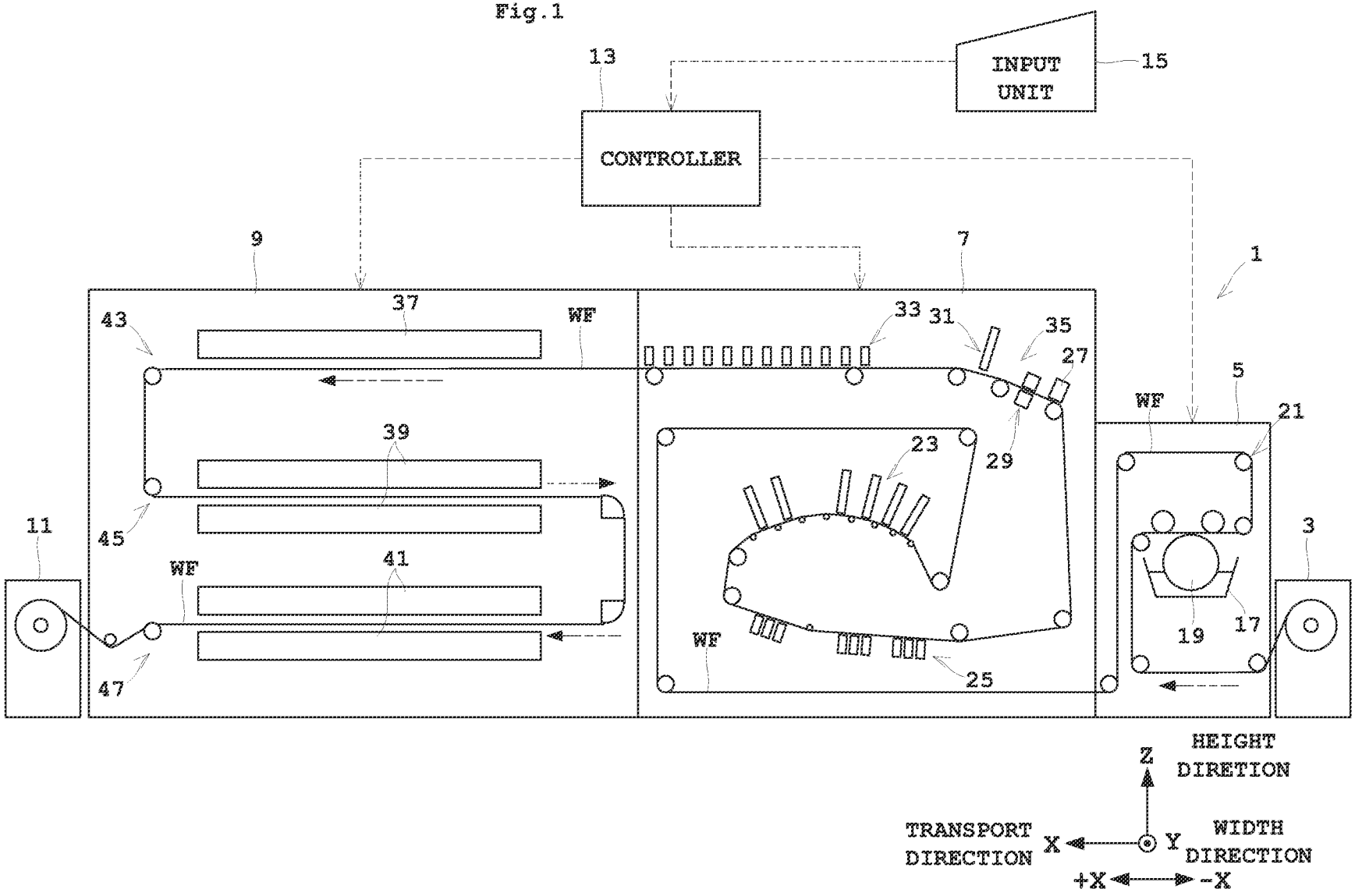
FIG. 1 is an outline schematic view showing an entire inkjet printing apparatus according to an embodiment.

FIG. 1 is an outline schematic view showing an entire inkjet printing apparatus according the embodiment.

An inkjet printing apparatus 1 according to the embodiment includes a sheet feeder 3, a coating unit 5, a printing unit 7, a main drying unit 9, a takeup roller 11, a controller 13, and an input unit 15. In the plane of FIG. 1, the right to left direction generally is assumed a transport direction X. Specifically, leftward in the transport direction X, i.e. the direction from right to left in the plane of FIG. 1, will be expressed +X direction. Rightward in the transport direction X, i.e. the direction from left to right in the plane of FIG. 1, will be expressed −X direction. The direction of depth from the plane of FIG. 1 is regarded as width direction Y. The up-down direction in FIG. 1 is height direction Z. The above-mentioned sheet feeder 3, coating unit 5, printing unit 7, main drying unit 9, and takeup roller 11 are arranged in the stated order in +X direction along the transport direction X.

The sheet feeder 3 supplies the coating unit 5 with soft wrapping film WF to be printed. The sheet feeder 3 holds a roll of soft wrapping film WF to be rotatable about a horizontal axis. The sheet feeder 3 unwinds the soft wrapping film WF, with a printing surface turned upward, into the coating unit 5. The material of soft wrapping film WF is a hydrophobic base material, for example, with a low absorbency for water-based ink. The soft wrapping film WF may be plastic film such as polypropylene resin, vinyl chloride resin, and polyimide resin, for example.

The above inkjet printing apparatus 1 corresponds to the "printing apparatus" in this invention. The soft wrapping film WF noted above corresponds to the "printing medium" in this invention.

The coating unit 5 coats the soft wrapping film WF with a primer for forming a primer layer thereon. The primer layer is also called a pretreatment layer, ink penetration layer, and ink absorbing layer. The primer is a coating solution and is also called a base coating solution, and surface preparation solution. Specifically, the coating unit 5 has a pan 17, a gravure roller 19, and a transport device 21. The pan 17 stores the primer. The gravure roller 19 has a lower portion thereof partially immersed in the primer stored in the pan 17 and an upper portion, by means of rotation, supplying the primer to the printing surface of soft wrapping film WF. The transport device 21 unwinds the soft wrapping film WF from the sheet feeder 3, and transports the soft wrapping film WF to the gravure roller 19. In the area where the primer is supplied to the gravure roller 19, the transport direction of the soft wrapping film WF is counter to the rotating direction of the circumferential surface of the gravure roller 19. The primer is applied to the soft wrapping film WF by what is called the reverse kiss mode. The transport device 21 transports the soft wrapping film WF from the coating unit 5 to the printing unit 7, with the soft wrapping film WF having the printing surface coated with the primer and facing up.

The printing unit 7 has a color printing section 23, a predrying section 25, a mark sensor 27, a printing position detecting mechanism 29, a white printing section 31, an upper drying section 33, and a transport device 35. The color printing section 23, by dispensing multicolor inks, for example, prints color images on the printing surface of soft wrapping film WF coated with the primer layer. The predrying section 25 dries by way of pretreatment the printing surface of soft wrapping film WF having gone through the color printing. The mark sensor 27 detects marks indicating printing areas set to the soft wrapping film WF. The printing position detecting mechanism 29 detects a lead line printed on the soft wrapping film WF. The printing position detecting mechanism 29 will be described in detail hereinafter. The white printing section 31 prints white images by dispensing white ink on the printing surface of soft wrapping film WF having gone through the color printing. The upper drying section 33 dries the printing surface of soft wrapping film WF where the white images have been printed. The transport device 35 transports the soft wrapping film WF from the color printing section 23 to the upper drying section 33. The printing unit 7 will be described in detail hereinafter.

The above transport device 35 corresponds to the "transport mechanism" in this invention.

The main drying unit 9 carries out a process of drying both the printing surface of soft wrapping film WF printed in the printing unit 7 and the reverse surface. Specifically, the main drying unit 9 has a first drying section 37, a second drying section 39, a third drying section 41, a first transport device 43, a second transport device 45, and a third transport device 47. The first drying section 37 dries the printing surface of soft wrapping film WF transported in +X direction of the transport direction X by the first transport device 43. The second drying section 39 dries both surfaces of soft wrapping film WF transported in −X direction of the transport direction X by the second transport device 45. The third drying section 41 dries both surfaces of soft wrapping film WF transported in +X direction of the transport direction X by the third transport device 47. The first drying section 37, second drying section 39, and third drying section 41 blow a gas heated to a predetermined temperature to the soft wrapping film WF. This dries the images printed on the printing surface of soft wrapping film WF.

The takeup roller 11 winds up the soft wrapping film WF having gone through the drying process by the main drying unit 9, into a roll form around a horizontal axis.

The controller 13 performs overall control of the coating unit 5, printing unit 7, and main drying unit 9. The controller 13 is formed of a CPU, memory, a communication unit, and so on. The controller 13 is connected to a host computer not shown. The images printed on the soft wrapping film WF are given as print data from the host computer to the controller 13. The input unit 15 is connected to the controller 13. The input unit 15 is operated by the operator of the inkjet printing apparatus 1. The operator operates the input unit 15 to input printing conditions. The operator operates the input unit 15 to give instructions at the time of changing the soft wrapping film WF. The input unit 15 is formed of a touch panel, a keyboard, a mouse, and so on. The controller 13 also performs position control of the printing position detecting mechanism 29 as described hereinafter.

The inkjet printing apparatus 1 according to this embodiment uses the back surface of soft wrapping film WF as printing surface, in what is called back printing. A printed product made by back printing has the back surface as printing surface pasted to a component, and the images are seen from the front surface of transparent soft wrapping film WF.

Figure 2:
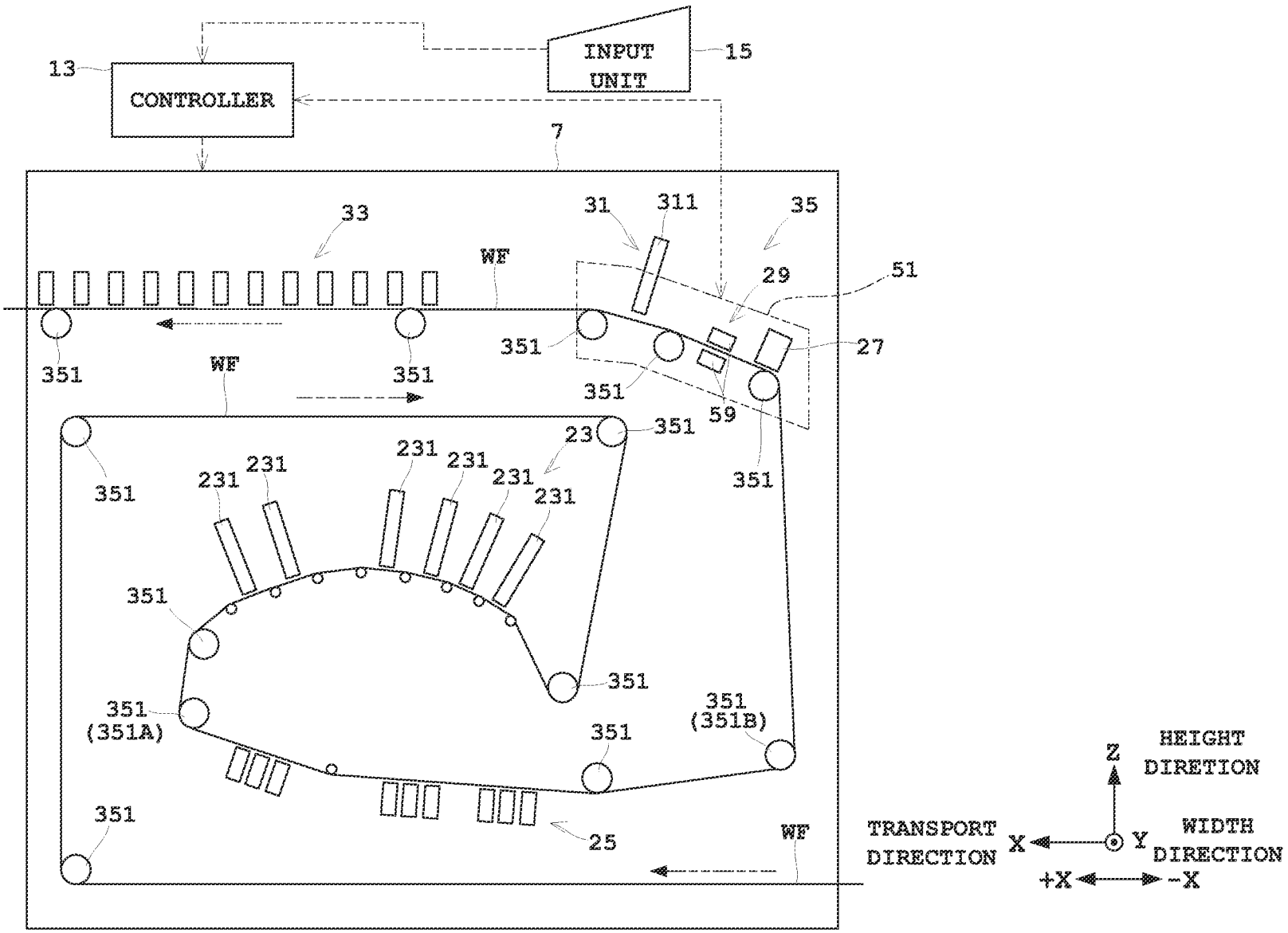
FIG. 2 is a front view showing details of a printing unit.

Details of the above printing unit 7 will now be described with reference to FIG. 2. FIG. 2 is a front view showing details of the printing unit 7.

The printing unit 7, with the transport device 35 having a plurality of transport rollers 351 including drive rollers, takes in the soft wrapping film WF from the coating unit 5, and from an upstream side in the transport direction X and downward in the height direction Z. The soft wrapping film WF taken in is transported in +X direction through a lowermost part of the printing unit 7, and then is turned and transported upward in the height direction Z. Further, the soft wrapping film WF has its transport direction turned in an upper position to move in the −X direction of the transport direction X. Then, the soft wrapping film WF is once turned in a lower position in the height direction Z to be transported downward, and its transport direction is changed toward the +X direction of the transport direction X again. The color printing section 23 is located on such transport route.

The color printing section 23 has a plurality of (e.g. six) dispensing heads 231. Each dispensing head 231 dispenses waterbase ink in an inkjet mode, for example. Each dispensing head 231 dispenses a different color ink, for example. The color inks are, for example, cyan (C), magenta (M), yellow (Y), and black (K). The color printing section 23 prints collar images on the printing surface of soft wrapping film WF by dispensing the color inks from the respective dispensing heads 231 to the printing surface of soft wrapping film WF. Each dispensing head 231 has a plurality of nozzles formed in the width direction Y. Specifically, the plurality of nozzles (not shown) are formed to cover the largest width of soft wrapping film WF printable by this apparatus. The plurality of nozzles are selectively used as required according to the width of printing areas set to the soft wrapping film WF.

The color-printed soft wrapping film WF, after turned downward in the height direction Z, is transported in the −X direction of the transport direction X by a transport roller 351. Here, this transport roller 351 is assumed to be transport roller 351A. The predrying section 25 is located in this area. The predrying section 25 dispenses the dry gas to the printing surface of soft wrapping film WF.

The soft wrapping film WF having passed the predrying section 25 has the direction changed by a transport roller 351 upward in the height direction Z. Here, this transport roller 351 is assumed to be transport roller 351B. In the upper part the soft wrapping film WF is transported by three transport rollers 351, and has the direction turned to the +X direction of the transport direction X. The white printing section 31 is located in the area to which the direction is changed. The white printing section 31 has one dispensing head 311. The dispensing head 311 is a nozzle of the inkjet mode, for example. The dispensing head 311 dispenses white ink to print white images on the printing surface of soft wrapping film WF where color images have been printed. The dispensing head 311 has a plurality of nozzles formed in the width direction Y. Specifically, a plurality of nozzles (not shown) are formed approximately over the largest printable width of soft wrapping film WF. The plurality of nozzles are selectively used as required according to the width of printing areas set to the soft wrapping film WF or a position from the end of soft wrapping film WF being transported.

Figure 3:
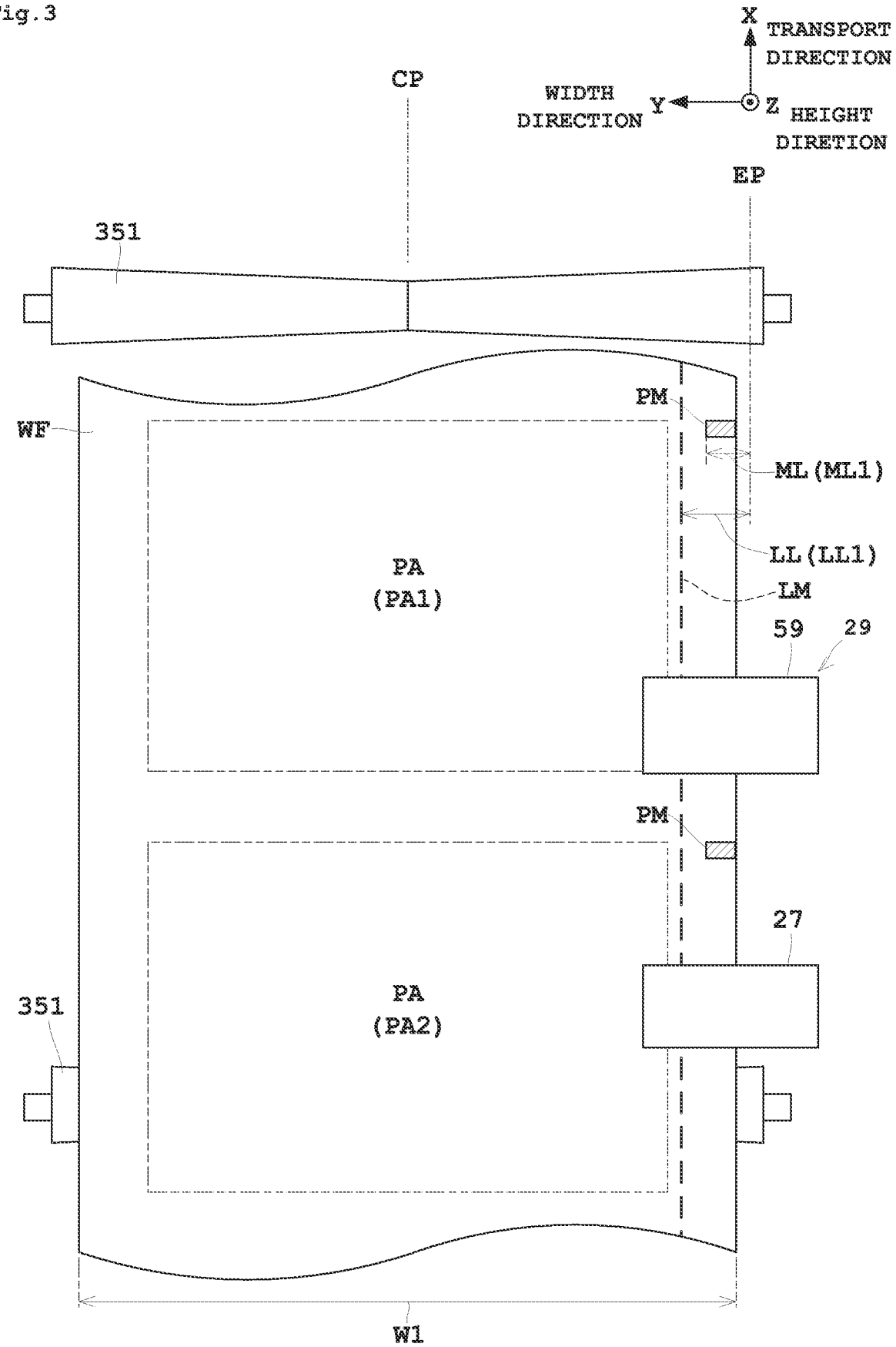
FIG. 3 is a view showing a positional relationship between a soft wrapping film and a printing position sensor.
Figure 4:
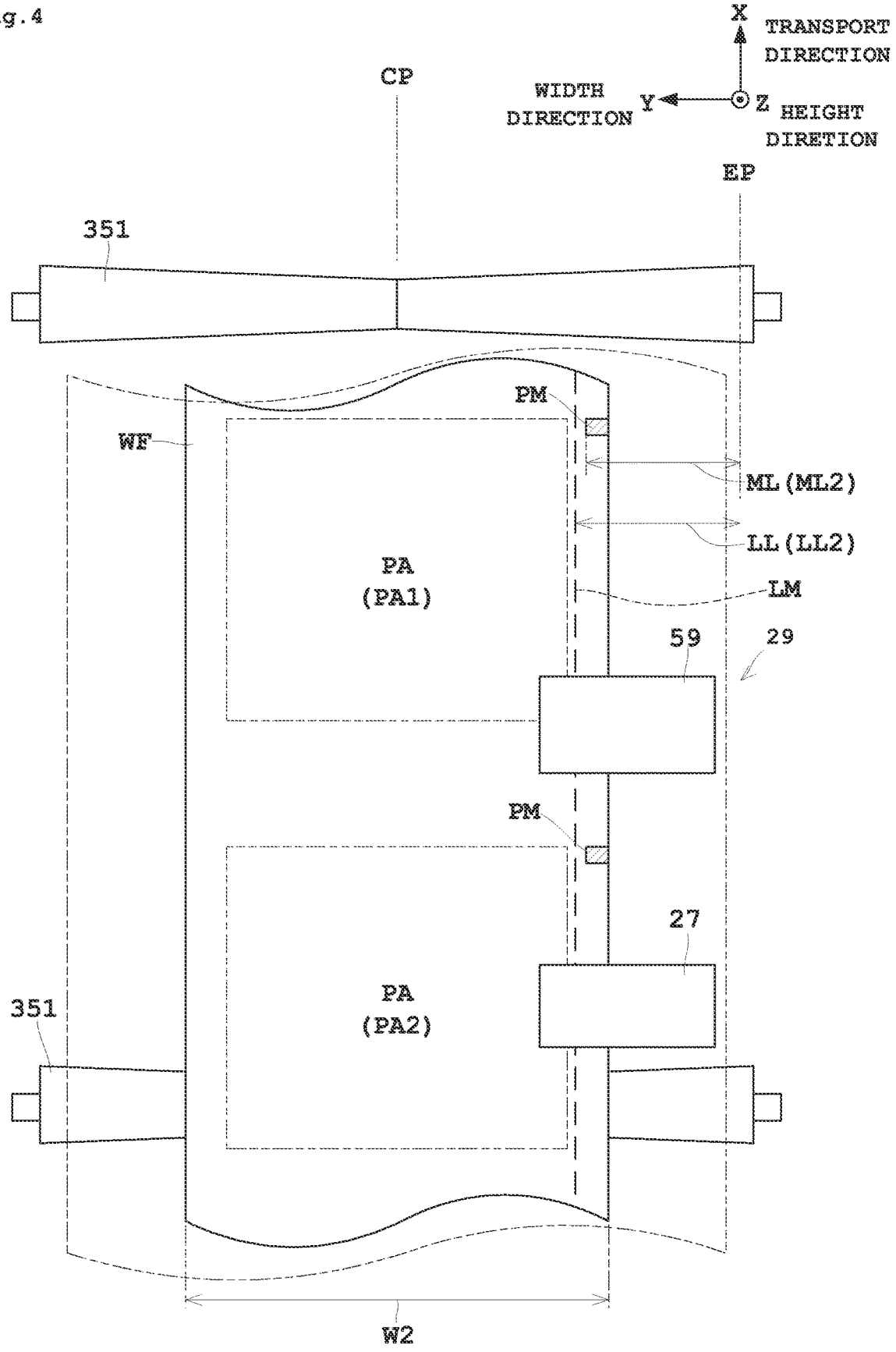
FIG. 4 is a view showing a positional relationship between a narrow soft wrapping film and the printing position sensor.

Reference is now made to FIGS. 3 and 4. FIG. 3 is a view showing a positional relationship between the soft wrapping film and a printing position sensor. FIG. 4 is a view showing a positional relationship between a narrow soft wrapping film and the printing position sensor.

The above transport roller 351 of the transport device 35 employed, preferably, is what is called a concave roller as shown in FIG. 3, for example. This concave roller has a thinner diameter in a central portion CP than at opposite ends in the width direction Y. The concave roller is also called an inverted crown roller. Consequently, the soft wrapping film WF is transported with the opposite ends under outward tension. Thus, even a thin printing medium like the soft wrapping film WF can be translated with little chance of creasing due to transportation. As a result, the printing quality of soft wrapping film WF can be improved. So, when a change is made from the soft wrapping film WF (width=W1) in FIG. 3 to a narrower soft wrapping film WF (width=W2, W2<W1) in FIG. 4, the central portion CP of soft wrapping film WF, and not the end of soft wrapping film WF, is used as reference.

The soft wrapping film WF has printing areas PA allocated thereto beforehand. Here, printing areas PA1, PA2, . . . have been allocated from a leading end of printing (from downstream in the transport direction X of FIG. 3), for example. The printing areas PA are allocated as spaced apart at predetermined intervals in the transport direction X. The printing areas PA are spaced from the opposite ends toward the central part CP of soft wrapping film WF. Q marks PM have been printed by the color printing section 23 between one side and printing areas PA of the soft wrapping film WF and downstream of the printing areas PA. These Q marks PM are printed in black (K) of the color printing section 23, for example. These Q marks PM indicate start positions of the printing areas PA.

A lead line LM is printed between the one side and printing areas PA of soft wrapping film WF. In particular, for example, the lead line LM is printed between the right-hand side along the transport direction X of soft wrapping film WF and the right-hand sides along the transport direction X of printing areas PA. The lead line LM is printed in a position a predetermined distance inward toward the central part CP from the right end face of soft wrapping film WF, for example. In the figure, the lead line LM is drawn in dotted lines to facilitate recognition. This lead line LM is printed by the color printing section 23. This lead line LM is printed in black (K) of the color printing section 23, for example.

The above Q marks PM are read by the mark sensor 27. The lead line LM is read by the printing position detecting mechanism 29. Detection signals from these are outputted to the controller 13. The position of the lead line LM detected by the position detecting mechanism 29 is constant from the end along the transport direction X of the soft wrapping film WF. However, the soft wrapping film WF, transported by way of the plurality of transport rollers 351 after being printed in the color printing section 23, usually has the end in a position different in the width direction Y from the position of the end when printed in the color printing section 23. It is therefore important, when printing in the white printing section 31, to determine in which position in the width direction Y the printing areas PA exist. For this purpose, the position of lead line LM detected by the printing position detecting mechanism 29 is used. That is, printing is performed while the position in the width direction Y is adjusted in the white printing section 31 with reference to the position of lead line LM detected by the printing position detecting mechanism 29.

The mark sensor 27 and printing position detecting mechanism 29, as shown in FIG. 3, are located in a position where the feeding direction is greatly changed by the transport roller 351A and transport roller 351B in the course of transport route of the soft wrapping film WF after the color images are printed in the color printing section 23. Downstream of this position, white images are printed by the white printing section 31. A plurality of transport rollers 351 are arranged between the color printing section 23 and white printing section 31. Of these transport rollers 351, the transport roller 351A and transport roller 351B switch the feeding direction to nearly right-angled directions. In other words, the transport roller 351A and transport roller 351B have a winding angle of about 90 degrees. The color images printed in the color printing section 23 are superposed with white images printed in the white printing section 31. However, there is a long transport distance from the color printing section 23 to the white printing section 31, with the feeding direction greatly changed by the transport roller 351A and transport roller 351B. That is, the white printing section 31 prints white images as additional printing to the printing areas PA where the color images have been printed in the color printing section 23. It is therefore important to make positional adjustment for fitting to the color images.

The above color printing section 23 corresponds to the "first print head" in this invention. The white printing section 31 corresponds to the "second print head" in this invention.

Figure 5:
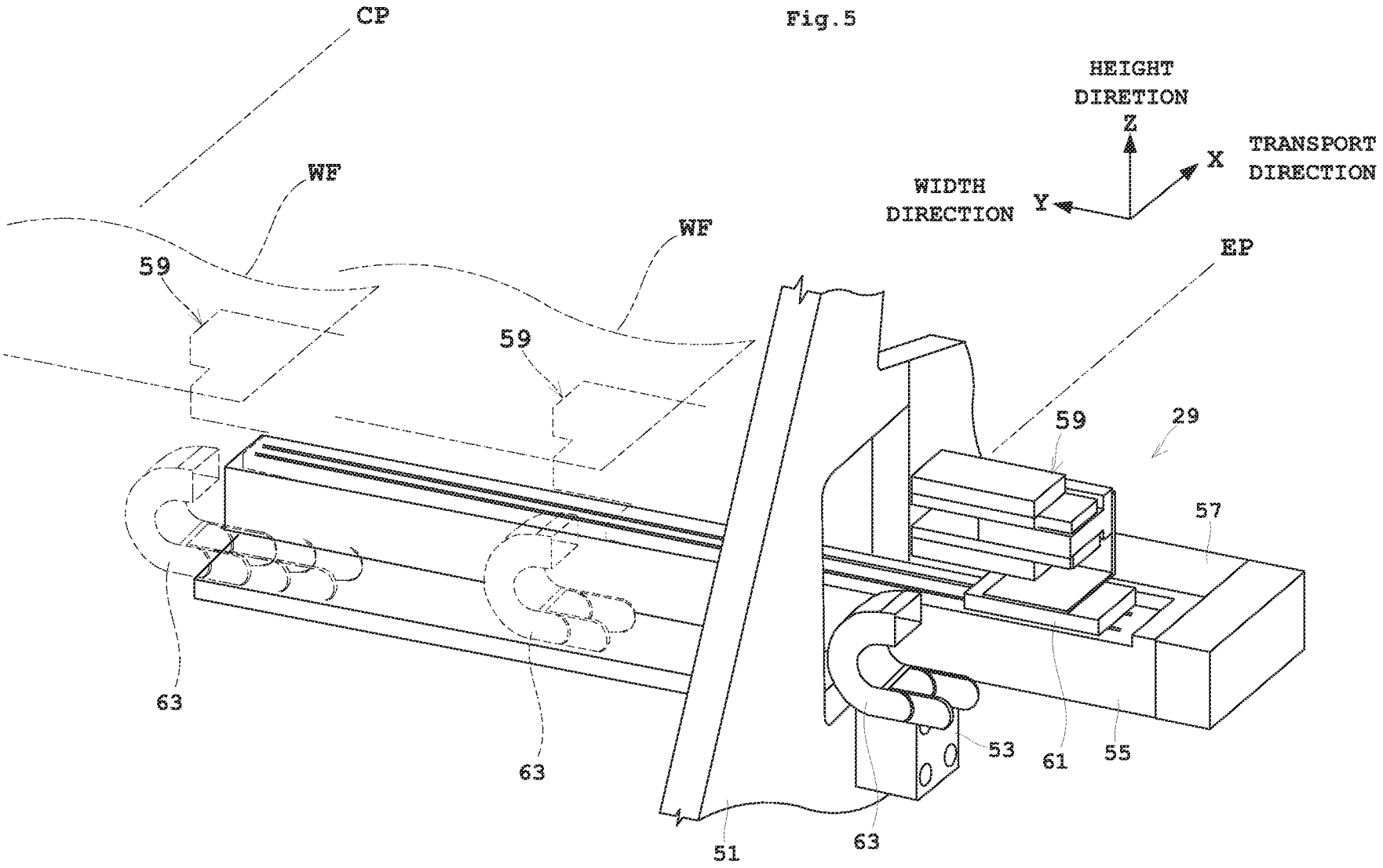
FIG. 5 is a perspective view showing one example of printing position detecting mechanism.

The printing position detecting mechanism 29 will now be described with reference to FIG. 5. FIG. 5 is a perspective view showing one example of printing position detecting mechanism.

The printing position detecting mechanism 29 is located along the transport route of soft wrapping film WF. Specifically, the printing position detecting mechanism 29 is attached to an apparatus frame 51 which rotatably holds the transport rollers 351.

The printing position detecting mechanism 29 has a mounting stay 53, a slider 55, a servomotor 57, and a printing position sensor 59. The mounting stay 53 fixes the slider 55 to the apparatus frame 51. Specifically, the slider 55 is mounted to have a long axis thereof extending in the width direction Y. The slider 55 has a mobile stage 61 which, with a built-in ball screw (not shown) thereof rotatable by the servomotor 57, moves forward and backward along the long axis of the slider 55. The printing position sensor 59, which is mounted on the mobile stage 61 to be movable therewith, has wiring electrically connected by a cableveyor (registered trademark) 63 to the apparatus frame 51. The printing position sensor 59 is U-shaped in vertical section opening sideways, for example. The printing position sensor 59 is a transmission type light sensor, for example. The printing position sensor 59 has a range of detection long in the width direction Y. Consequently, the printing position sensor 59, in a state of being fixed in a certain position in the width direction Y, can detect the position of the lead line LM even if the latter moves in a constant range in the width direction Y.

The printing position detecting mechanism 29 is constructed capable of moving the printing position sensor 59 to an origin EP located outside the apparatus frame 51 in the width direction Y, and at least a first position having moved to a central portion CP from the origin EP and a second position further moved in the central portion CP from the first position. The position of the printing position sensor 59 at the origin EP is a position shown in solid lines in FIG. 5. This origin EP is a position where an end of a soft wrapping film WF having the largest width dimension transported will not contact the printing position sensor 59. The first position is a position shown in a dotted line in FIG. 5. This is a position for the time of printing the soft wrapping film WF of the largest width, for example. This first position is a position for enabling the printing position sensor 59 to detect the lead line LM shown in FIG. 3. The distance LL from the origin EP of this lead line LM is distance LL1. The second position is a position shown in a two-dot chain line in FIG. 5. This is a position for the time of printing the soft wrapping film WF of the smallest width, for example. This is a position for enabling detection of the lead line LM shown in FIG. 4. The distance LL from the origin EP of this lead line LM is distance LL2 (>LL1). The position to be taken for detection may be set according to the width dimension of soft wrapping film WF used in the inkjet printing apparatus 1.

The printing position detecting mechanism 29 corresponds to the "moving mechanism" in this invention. The first position noted above corresponds to the "outer position" in this invention. The second position corresponds to the "inner position" in this invention. The above servomotor 57 corresponds to the "actuator" in this invention.

As shown in FIGS. 3 and 4, when the soft wrapping film WF has width dimension W1, distance LL in the width direction Y from the origin EP to the lead line LM is LL1. When the soft wrapping film WF has width dimension W2 narrower than width dimension W1, distance LL in the width direction Y from the origin EP to the lead line LM is LL2 (>LL1). Similarly, when the soft wrapping film WF has width dimension W1, distance ML in the width direction Y from the origin EP to the Q marks PM is ML1. When the soft wrapping film WF has width dimension W2 narrower than width dimension W1, distance ML in the width direction Y from the origin EP to the Q marks PM is ML2 (>ML1). In the following description, since similar constructions can provide movements, only the movement of the printing position sensor 59 is described and description of the movement of the mark sensor 27 will be omitted.

The movements of the printing position sensor 59 by the printing position detecting mechanism 29 to the origin EP, first position, and second position are conducted by the controller 13 described hereinbefore.

Figure 6:
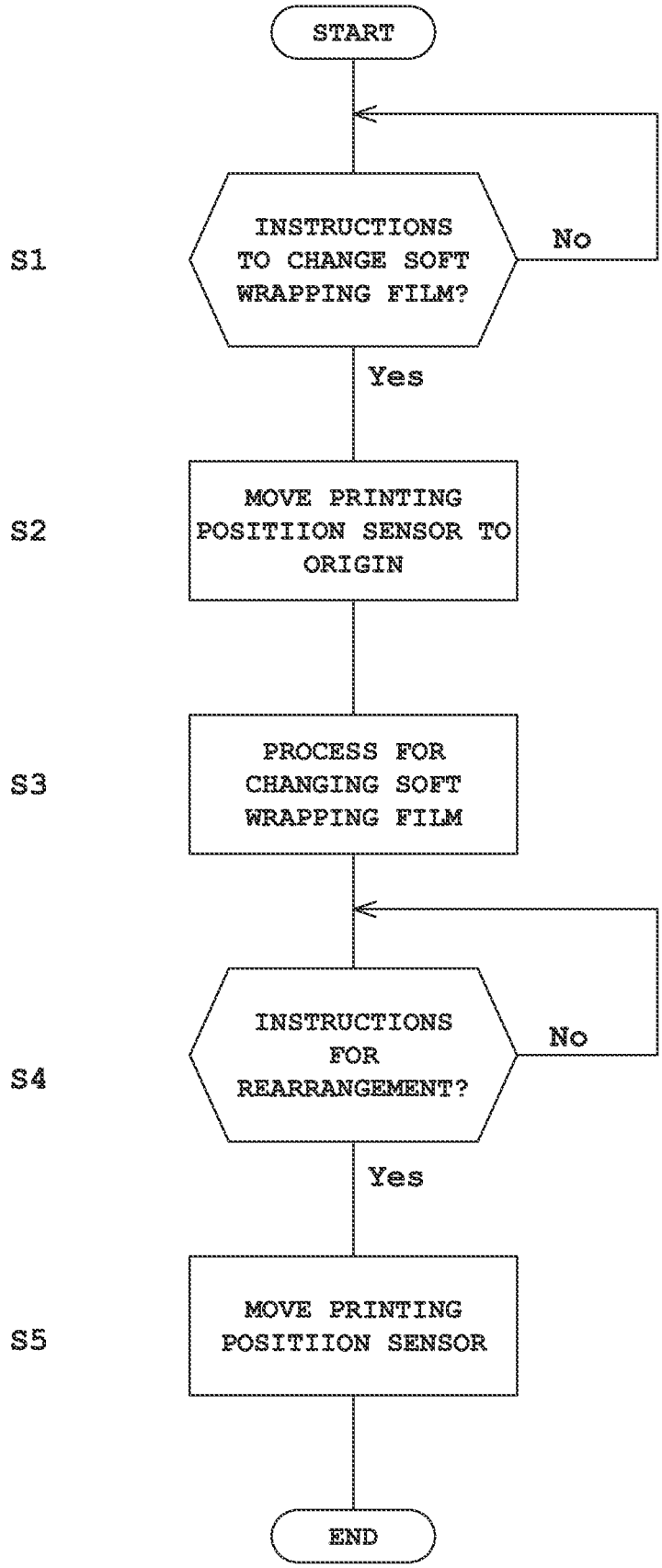
FIG. 6 is a flow chart showing an operation for changing the soft wrapping film.

Description will now be made, with reference to FIG. 6, of an operation of the inkjet printing apparatus 1 having the foregoing construction at the time of changing the soft wrapping film WF. FIG. 6 is a flow chart showing an operation for changing the soft wrapping film. It is assumed that currently the inkjet printing apparatus 1 is loaded with the soft wrapping film WF having width dimension W1, and that a printing process is going on in the state shown in FIG. 3. Thus, the printing position sensor 59 is located in the first position, and is detecting the position of lead line LM at distance LL1 from the origin EP. According to this position detected of lead line LM, the controller 13 is adjusting the printing position in the width direction Y of the white printing section 31. Consequently, even if a shift occurs with the transported position of the soft wrapping film WF in the width direction Y while transporting after printing in the color printing section 23, the detected position of lead line LM is also moved accordingly. Thus, the printing position in the width direction Y is adjusted in the white printing section 31 according to the position of lead line LM detected by the printing position sensor 59. The printing of white images additional to the color printing is therefore performed with high accuracy.

Step S1

The operator of the apparatus gives instructions to change the soft wrapping film WF currently used to a medium having a different width dimension. Specifically, the operator gives the instructions by operating the input unit 15. When these instructions are given, the process moves to step S2. It is assumed here that the change is made to soft wrapping film WF of width dimension W2 which is narrower than the current width dimension W1, for example. At this time, the instructions for width dimension W2 are transmitted from the input unit 15.

Step S2

The controller 13 operates the printing position detecting mechanism 29 to move the printing position sensor 59 to the origin EP, temporarily withdrawing the printing position sensor 59.

Step S3

The operator of the apparatus carries out an operation for changing to the soft wrapping film WF having the width dimension W2.

Step S4

When the replacement process for the soft wrapping film WF of width dimension W2 is completed, the operator of the apparatus operates the input unit 15 to instruct a rearrangement. Upon instructions for the rearrangement, the process moves to step S5.

Step S5

The controller 13 operates the printing position detecting mechanism 29 based on the width dimension W2. Specifically, the servomotor 57 is operated to move the printing position sensor 59 to the second position. Upon completion of the movement to the second position of the printing position sensor 59, the controller 13 reports the completion to the operator of the apparatus. The report may be made by way of indication on a display, lighting of a lamp, or vocally through a speaker not shown, for example. The operator of the apparatus operates the input unit 15 to start a printing process for the soft wrapping film WF of width dimension W2, for example.

According to this embodiment, the color printing section 23 prints color images along with the lead line LM on the soft wrapping film WF transported by the transport device 35. The white printing section 31 performs additional printing fitting with the color images by the color printing section 23 based on the lead line LM. The printing position sensor 59, which detects the lead line LM, is moved in the width direction Y of the soft wrapping film WF by the printing position detecting mechanism 29. Consequently, even when a change is made to a soft wrapping film WF of different width dimension, the printing position sensor 59 can be moved to an appropriate position. As a result, even when a change is made to the soft wrapping film WF of different width dimension, high quality printing can be assured.

The controller 13 controls the printing position detecting mechanism 29 according to the width dimension inputted at the input unit 15. This enables an automatic movement to a position suitable for detecting the lead line LM according to the width dimension of the soft wrapping film WF. As a result, the printing position sensor 59 is never moved to a wrong position, hence no lowering of printing quality.

Further, according to this embodiment, when a change is made to a soft wrapping film WF of different width dimension, the printing position sensor 59 is once withdrawn to the origin EP outward of the first position. After changing the soft wrapping film WF, the printing position sensor 59 is moved to the first position or second position according to the width dimension. Consequently, when changing to a wide soft wrapping film WF, the soft wrapping film WF is prevented from accidentally contacting the printing position sensor 59 to be damaged.

This invention is not limited to the foregoing embodiment, but may be modified as follows:

(1) In the foregoing embodiment, the moving mechanism is in the form of the printing position detecting mechanism 29. However, this invention is not limited to such a moving mechanism. That is, any construction will do as long as it can move the printing position sensor 59 in the width direction Y of the soft wrapping film WF.

(2) The foregoing embodiment has been described taking the transparent soft wrapping film WF as an example of printing medium. However, this invention is not limited to the transparent soft wrapping film WF. For example, the invention is applicable also to translucence or opaque soft wrapping film WF. This invention is applicable not only to film but also to paper. In the case of opaque printing medium, the printing position sensor 59 may be a reflection type light sensor rather than the transmission type light sensor.

(3) In the foregoing embodiment, printing is done in the color printing section 23 and white printing section 31 by adjusting printing positions in the width direction Y. However, this invention is applicable to any apparatus that has a first print head for printing the lead line LM, and a second print head for executing printing based on the lead line LM in a position separate downstream from the first print head.

(4) In the foregoing embodiment, the inkjet printing apparatus 1 has been described as an example of printing apparatus. However, this invention is not limited to the inkjet printing apparatus 1. That is, this invention is applicable to any printing apparatus that has a first print head, and a second print head located apart therefrom for performing additional printing based on the lead line LM.

(5) In the foregoing embodiment, the transport rollers 351 of the transport device 35 are concave rollers. However, this invention is not limited to the transport rollers 351 shaped as such. For example, the transport rollers may have a cylindrical shape with a constant diameter.

This invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus for printing on a printing medium, the printing apparatus comprising:

a transport mechanism for transporting the printing medium in a transport direction;

a first print head for printing an image on the printing medium transported by the transport mechanism, and printing a lead line used as a reference for determining a printing position in a width direction of the printing medium, the lead line continuously extending in the transport direction;

a printing position sensor for detecting a position of the lead line in the width direction of the printing medium;

a second print head disposed downstream of the first print head for performing printing according to the image printed by the first print head while adjusting the printing position in the width direction with reference to the position of the lead line in the width direction of the printing medium detected by the printing position sensor as the reference;

a moving mechanism for moving the printing position sensor in the width direction of the printing medium according to a width dimension of the printing medium;

an input unit for inputting a width dimension of the printing medium inputted by an operator prior to starting printing using the first print head and the second print head on a printing medium with a different width; and a controller for controlling the moving mechanism according to the width dimension inputted at the input unit in order to move the printing position sensor, wherein the printing position sensor is disposed downstream of the first print head and upstream of the second print head.

2. The printing apparatus according to claim 1, wherein the width dimension of the printing medium is input to the input unit before replacement to the printing medium with the different width is completed as the transport mechanism.

3. The printing apparatus according to claim 1, wherein the moving mechanism includes:

a slider for supporting the printing position sensor to be movable at least between an inner position in the width direction appropriate to a minimum width of the printing medium and an outer position in the width direction appropriate a maximum width of the printing medium; and an actuator for moving the printing position sensor along the slider.

4. The printing apparatus according to claim 2, wherein the moving mechanism includes:

a slider for supporting the printing position sensor to be movable at least between an inner position in the width direction appropriate to a minimum width of the printing medium and an outer position in the width direction appropriate a maximum width of the printing medium; and an actuator for moving the printing position sensor along the slider.

5. The printing apparatus according to claim 3, wherein, when the printing medium is replaced with a printing medium having a different width dimension, the printing position sensor is once withdrawn outward of the outer position, the printing medium having the different width dimension is installed, and thereafter the printing position sensor is moved toward the inner position appropriate to the width dimension.

6. The printing apparatus according to claim 4, wherein, when the printing medium is replaced with a printing medium having a different width dimension, the printing position sensor is once withdrawn outward of the outer position, the printing medium having the different width dimension is installed, and thereafter the printing position sensor is moved toward the inner position appropriate to the width dimension.

7. The printing apparatus according to claim 1, wherein the printing position sensor is located in a position resulting from the transport direction switched to a substantially right-angled direction at least twice by the transport mechanism after the printing by the first print head.

8. The printing apparatus according to claim 2, wherein the printing position sensor is located in a position resulting from the transport direction switched to a substantially right-angled direction at least twice by the transport mechanism after the printing by the first print head.

9. The printing apparatus according to claim 3, wherein the printing position sensor is located in a position resulting from the transport direction switched to a substantially right-angled direction at least twice by the transport mechanism after the printing by the first print head.

10. The printing apparatus according to claim 4, wherein the printing position sensor is located in a position resulting from the transport direction switched to a substantially right-angled direction at least twice by the transport mechanism after the printing by the first print head.

11. The printing apparatus according to claim 5, wherein the printing position sensor is located in a position resulting from the transport direction switched to a substantially right-angled direction at least twice by the transport mechanism after the printing by the first print head.

12. The printing apparatus according to claim 6, wherein the printing position sensor is located in a position resulting from the transport direction switched to a substantially right-angled direction at least twice by the transport mechanism after the printing by the first print head.

13. The printing apparatus according to claim 1, wherein the first print head is a color printing section for dispensing color inks, and the second print head is a white printing section for additionally printing a white image in a printing area where a color image has been printed by the color printing section.

14. The printing apparatus according to claim 2, wherein the first print head is a color printing section for dispensing color inks, and the second print head is a white printing section for additionally printing a white image in a printing area where a color image has been printed by the color printing section.

15. The printing apparatus according to claim 3, wherein the first print head is a color printing section for dispensing color inks, and the second print head is a white printing section for additionally printing a white image in a printing area where a color image has been printed by the color printing section.

* * * * *